US007310288B2

(12) United States Patent
Simonian

(10) Patent No.: US 7,310,288 B2
(45) Date of Patent: Dec. 18, 2007

(54) WATCH MOVEMENT EQUIPPED WITH AN ANIMATION

(75) Inventor: Sasnik Simonian, Antelias (LB)

(73) Assignee: Hovik Simonian, La Chaux-de-Fonds (CH)

( * ) Notice: Subject to any disclaimer, the term of this patent is extended or adjusted under 35 U.S.C. 154(b) by 0 days.

(21) Appl. No.: 10/569,815

(22) PCT Filed: Aug. 27, 2004

(86) PCT No.: PCT/CH2004/000542

§ 371 (c)(1),
(2), (4) Date: Dec. 7, 2006

(87) PCT Pub. No.: WO2005/022276

PCT Pub. Date: Mar. 10, 2005

(65) Prior Publication Data

US 2007/0165490 A1 Jul. 19, 2007

(30) Foreign Application Priority Data

Aug. 29, 2003 (EP) ..... 03405624

(51) Int. Cl.
*G04B 19/00* (2006.01)
*G04B 19/02* (2006.01)
*G04C 21/00* (2006.01)

(52) U.S. Cl. ..... 368/76; 368/220; 368/223

(58) Field of Classification Search ..... 368/76, 368/80, 220, 223, 285
See application file for complete search history.

(56) References Cited

U.S. PATENT DOCUMENTS 2,995,005 A 8/1961 Boyles
3,665,700 A * 5/1972 Ditello et al. ..... 368/131
3,762,154 A * 10/1973 Petrides ..... 368/80
4,734,895 A * 3/1988 Grosskopf ..... 368/229
4,839,874 A * 6/1989 Namisato ..... 368/76
4,985,877 A * 1/1991 Namisato ..... 368/76

FOREIGN PATENT DOCUMENTS

| | | |
|---|---|---|
| CH | 30220 | 11/1904 |
| CH | 32577 | 8/1905 |
| CH | 32578 | 8/1905 |
| FR | 630190 | 11/1927 |

OTHER PUBLICATIONS

PCT International Search Report, for PCT/CH2004/000542, mailed Jan. 25, 2005 (3 pages).

* cited by examiner

*Primary Examiner*—Vit W Miska
(74) *Attorney, Agent, or Firm*—Finnegan, Henderson, Farabow, Garrett & Dunner, LLP

(57) ABSTRACT

A mechanical-type watch movement is disclosed. In one implementation, the movement may include a frame. The frame may support a work train that is periodically driven in rotation by a driving element. The frame may also support an animation part. The animation part may be configured to be visible, and may be arranged to be animated by an oscillating movement that is capable of simulating, for example, a pendulum movement. The movement may also include, supported by the frame, an animation train that meshes with a mobile of the work train, and is kinematically connected to the animation part.

9 Claims, 6 Drawing Sheets

WATCH MOVEMENT EQUIPPED WITH AN ANIMATION

This application is a national stage filing under 35 U.S.C. § 371 of International Application No. PCT/CH2004/000542, filed on Aug. 27, 2004, which claims priority to European Application No. 03405624.2, filed on Aug. 29, 2003, the disclosures of which are expressly incorporated herein by reference to their entireties.

TECHNICAL FIELD

The present invention relates to watch movements and more particularly, to watch movements including a visible mobile element ensuring an animation of a display.

Embodiments of the present invention include a mechanical-type watch movement, comprising a frame and, supported by the frame:

- a work train comprising a plurality of mobiles periodically driven in rotation by a driving element,
- a mobile animated by a pulsed movement and including a kinematic connection with the work train,
- an animation part configured to be visible and arranged to be animated by a periodic movement,
- a control element for the animation part, and
- an animation train in mesh with a mobile of the work train and driving the control element.

BACKGROUND INFORMATION

A watch movement is described, for example, in patent CH 30.220, which proposes to animate a figurine by means of a wheel connected to a work train comprising ratchet teeth. The latter periodically drives a rod forming part of an automaton. Such a solution has the drawback that the movement of the automaton is jerky, owing to jumps over the ratchet teeth.

Furthermore, watches are known such as that described in document FR 630.190, in which a pendulum image is fixed on a pallet fork of an escapement. This image is thereby abruptly displaced with each alternation. Here, too, the movement is jerky and therefore more irritating than calming.

SUMMARY OF THE INVENTION

An object of an exemplary embodiment of the present invention is to realize an animation in which the jerks due to the pulsed movement of an escapement or of a motor are gradually dampened in order that the movement of an automaton is uniform and jerk-free. To this end, a watch movement according to one aspect of the invention may include an animation train, a control element and an animation part, arranged in such a way that movement of the automaton has a sinusoidal oscillation movement.

In order to obtain an optimal simulation quality, an elastic element may be interposed between a mobile of a work train with which the animation train is in mesh and the animation part, thus forming a mechanical filter through the combination of the elastic element with the inertia of the mobiles of the animation train, the control element and the animation part.

From the point of view of the arrangement of the various components, it may be advantageous for the animation train to be connected to the work train by a seconds mobile. In such an embodiment, the animation train may be arranged to accelerate the rotation speed of the seconds mobile toward the mobile cooperating with the animation part.

Advantageously, the animation part may oscillate at a frequency ranging between 0.2 and 2 Hz.

In one particular embodiment, the movement may also include a lever. A last mobile of the animation train may be equipped with a board. Moreover, the animation part and the board may be equipped with eccentrically disposed connecting means arranged to be connected to one of the ends of the lever, in order to form a connecting rod connecting the animation train to the animation part.

In a first variant, the lever may include, over at least a part of its length, an elastically deformable structure, arranged in such a way as to constitute the elastic element.

In a second variant, the elastic element may elastically connect two coaxial mobiles of the animation train.

Advantageously, the elastic element may form, with the animation part and the mobile(s) of the train interposed between that which may cooperate with the animation part and that which may be connected to the elastic element, an oscillating system, having a period ranging between that the mobiles of the work train and that of the periodic movement of the animation part.

In order to make the animation part as shockproof as possible, it may be mounted pivotably on the frame, and its center of gravity may be located substantially on its pivot axis.

In order to allow the use of an already existing watch caliber, the frame of the movement according to an embodiment of the invention may include:

- a first plate and a first bridge, between which pivot the mobiles of the work train, and
- a second plate on which pivot the mobiles of the animation train and the animation part, the second plate, the animation train and the animation part together forming an independent module which can be fixed by the second plate onto the first plate.

It is clear that all or part of the animation train can likewise pivot within a bridge, which may be fixed on the second plate.

BRIEF DESCRIPTION OF THE DRAWINGS

Other advantages and characteristics of the invention will emerge from the following description, made with regard to the appended drawings, in which.

DETAILED DESCRIPTION

Figure 1:
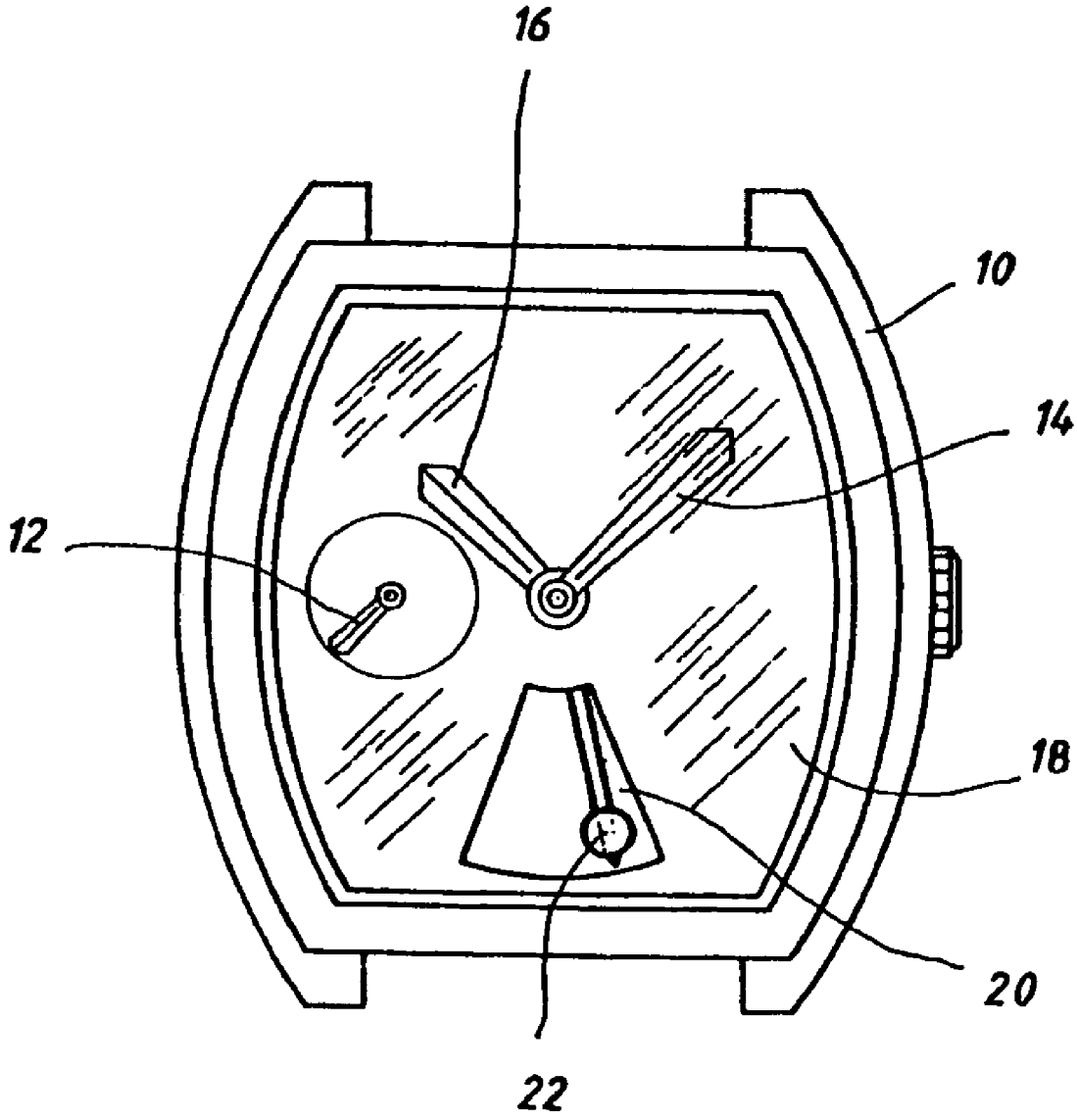
- FIG. 1 represents a watch equipped with a watch movement according to one exemplary embodiment of the invention.

The watch represented in FIG. 1 comprises a case 10 defining a receptacle in which there may be disposed a watch movement which will be described with reference to, for example, FIGS. 2 to 5. The movement may include a work train and a minute train bearing, respectively, second hands 12, minute hands 14 and hour hands 16. A dial 18 may be interposed between the movement and the hands. Dial 18 may be pierced by a window 20, through which can be seen an animation part 22, arranged in such a way as to simulate the movement of a pendulum, as will be explained below.

Figure 2:
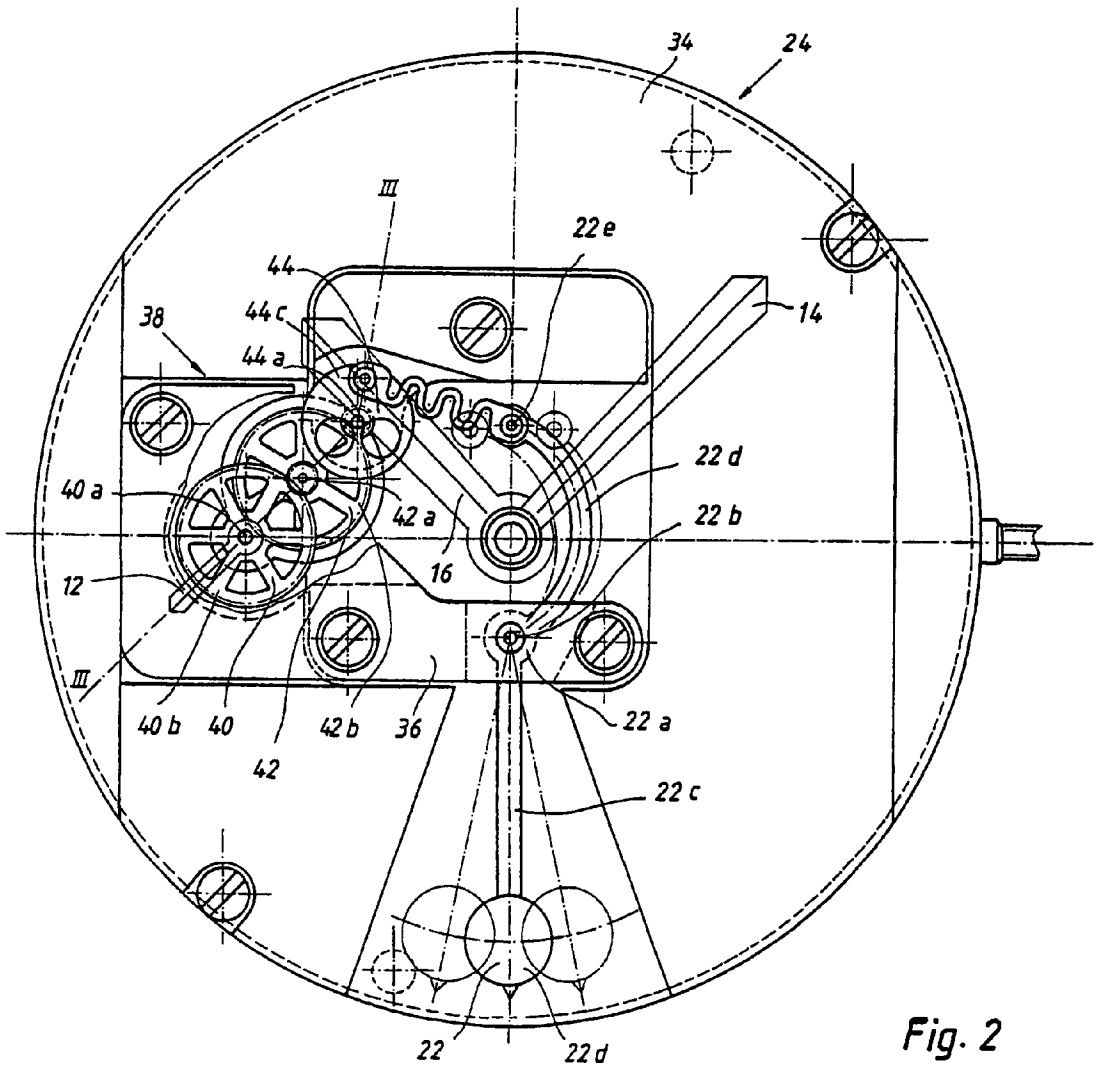
- FIG. 2 is a plan view of a part of the watch movement according to one exemplary embodiment of the invention.

FIG. 2 shows, in top view, a watch movement 24 according to one exemplary embodiment of the invention. Watch movement 24 is housed in case 10. In FIG. 2, dial 18 has been removed, and hands 12, 14 and 16 are visible in transparency. Animation part 22 can likewise be seen, with its extreme positions shown in dotted representation.

Figure 3:
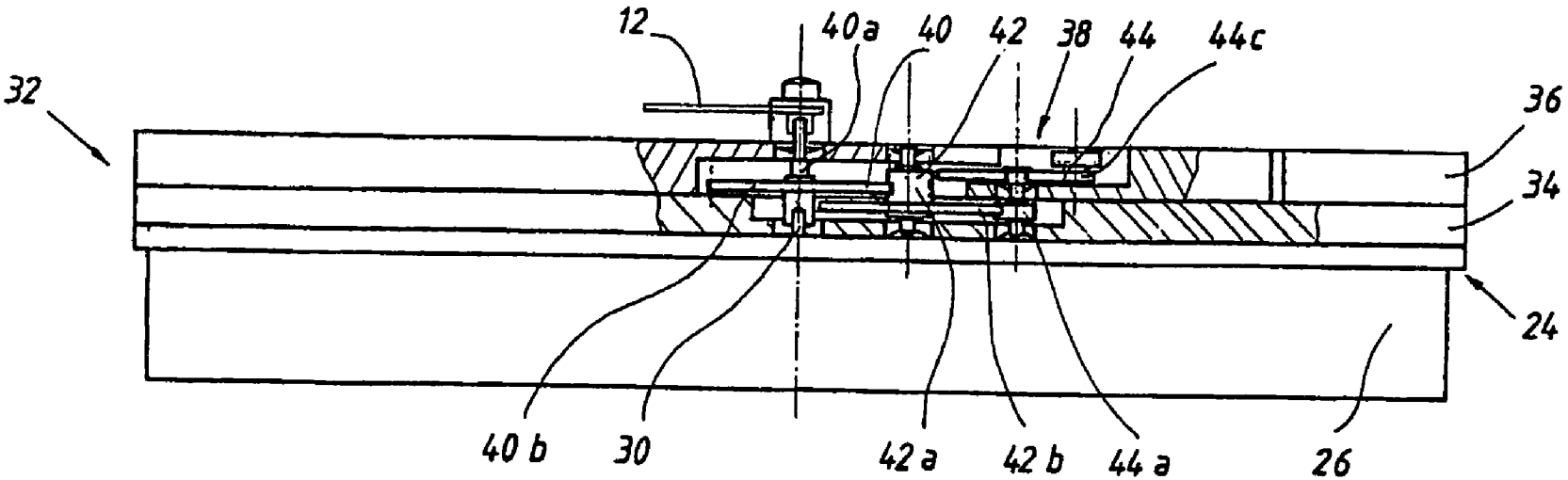
- FIG. 3 is a sectional view along the lines III-III of the movement part illustrated in FIG. 2.

Movement 24 may include a base caliber 26, represented schematically in side view in FIG. 3, ensuring the vital functions of a timepiece, i.e. the power supply, the generation of a base frequency, the mechanical division by means of trains, as well as the correction functions. The time base of movement 24 may include a quartz, a hairspring, and/or any other suitable time base known in the art.

Caliber 26 may be equipped with a plate and a bridge (neither of which is referenced), and with a work train that includes mobiles that may be pivotably mounted between the plate and the bridge. Only the end of a seconds mobile 30 is visible in FIG. 3. A minute train, which is also not shown in FIG. 3, may bear and carry out the driving of minute hands 14 and hour hands 16.

Base caliber 26 may bear a module 32 that includes a plate 34 and a bridge 36 which, together, may serve as support for an animation train 38. The latter may include three mobiles 40, 42 and 44, each formed by a pinion identified by the letter "a", and by a wheel identified by the letter "b", with the exception of mobile 44, which may include a pinion 44*a* and a board 44*c*, but no wheel.

Mobile 40 may be coaxial to seconds wheel 30. Pinion 40*a* may be equipped with a hole engaged in the end of seconds mobile 30, the hole and the end being arranged in such a way that mobiles 30 and 40 may rotate as one, owing, for example, to an indentation arranged on pinion 40*a*. In such an embodiment mobile 40 may be press-fitted on the end of mobile 30.

The wheel 40*b* may drive pinion 42*a* and, with it, wheel 42*b*, which may mesh with pinion 44*a* of the mobile 44.

Mobiles 40, 42 and 44 may be numbered in such a way that the speed of rotation of mobile 44 may be of the order of 1 revolution per second, typically ranging between 0.2 and 2 revolutions per second.

Figure 5:
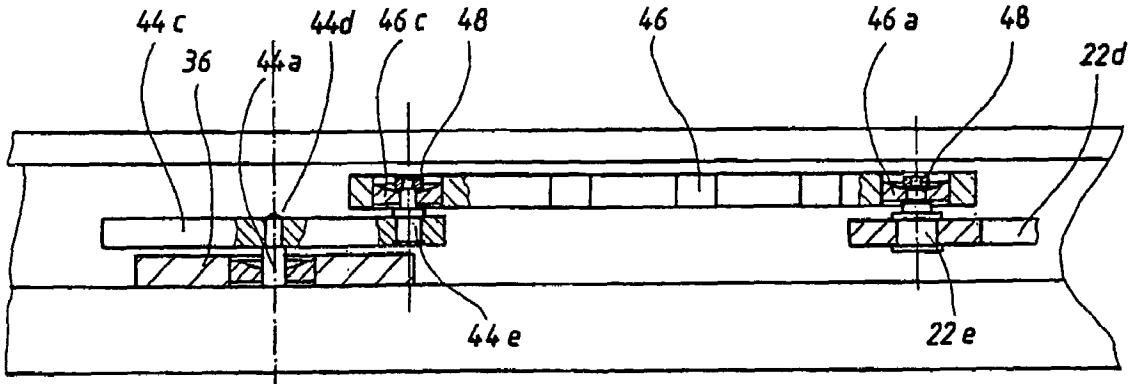
- FIGS. 4 and 5 show, on a larger scale and respectively in plan view and in section, a part of the movement of FIGS. 2 and 3.
Figure 4:
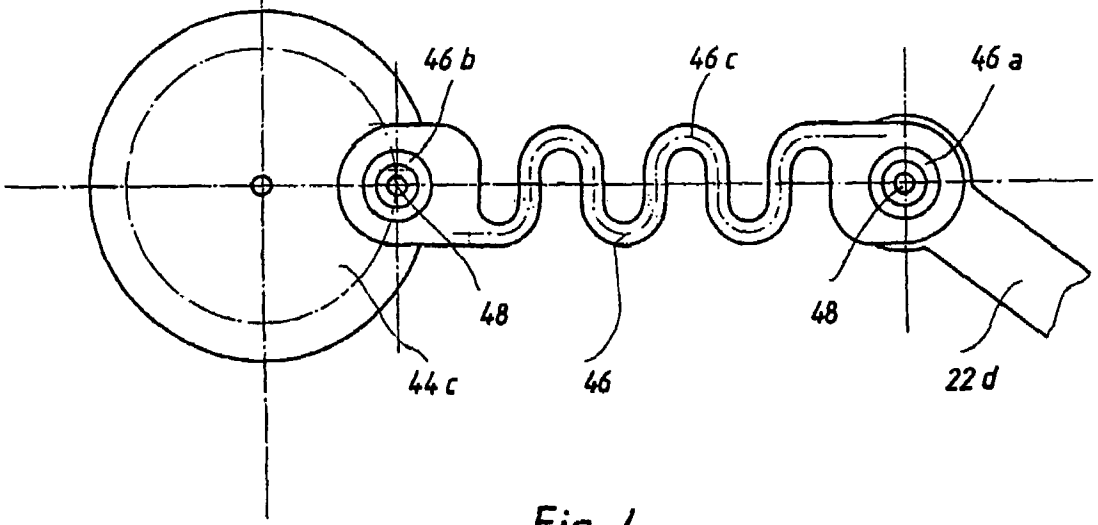

Mobiles 40 and 42, as well as pinion 44*a*, may be disposed between and may pivot between plate 34 and bridge 36. As can be seen in FIG. 5, pinion 44*a* is may be equipped with a pivot 44*d* projecting from bridge 36 and on which board 44*c* may be press-fitted. The latter may support a rod 44*e*, the function of which will be specified further below.

Animation part 22 may include a central portion 22*a* (FIG. 2) equipped with a hole in which a shaft 22*b*, pivotably mounted between the plate 34 and the bridge 36, proximate to the center of the movement, may be press-fitted. Two arms 22*c* and 22*d* may extend on either side of central portion 22*a*. The free end of arm 22*c* may include a bob 22*d*, which may be apparent through window 20, and may simulate the bob of a pendulum. The end of arm 22*d* may be equipped with a rod 22*e*, which can better be seen in FIG. 5 and may be intended to secure a connection with the board 44*c*, via a lever 46 pivotably mounted on rods 44*e* and 22*e*. Thus, mobile 44 and lever 46 together may form a control element for animation part 22.

Lever 46 may include two watchmaker's jewels 46*a* and 46*b*, press-fitted respectively at one and the other of its ends. One of the jewels 46*a* and 46*b* may cooperate with rod 22*e*, and the other may cooperate with rod 44*e*. In its middle part 46*c*, lever 46 may include a serpentine structure, which may give it greater elasticity than a straight bar.

Lever 46 may be held on rods 22*e* and 44*e* by sleeves 48 press-fitted on rods 22*e* and 44*e*, leaving a sufficient space with jewels 46*a* and 46*b* to ensure that these are not impeded in their movement.

Mobile 44 and lever 46 thus together may form a connecting rod system driving animation part 22.

In the watch which has just been described, when it is of the hairspring type, the seconds wheel may perform a slight jump each time that an escapement gives an impetus to a balance wheel. This may occur with each semioscillation, i.e. from 5 to 10 times per second. This frequency may be too low to simulate a continuous movement. In practice, the duration of the impetus may be of the order of 1% of the time of the half-period. For the pendulum to give the illusion of having a continuous and sinusoidal movement, it may be necessary to introduce an element that may dampen the movement, such as, for example, serpentine structure 46*c*, which may lend a greater elasticity to lever 46.

Additionally or alternatively, elastic structure 46*c* of lever 46 could be replaced by mounting wheel 42*b* in a freely rotatable manner on pinion 42*a*, and by connecting them with a flat spiral spring (not shown).

In order to obtain an optimal simulation, the period of the unit formed by animation part 22 and elastic element 46*b* may range between that defined by the periodicity of the advancement of the work train and that of the oscillating movement of animation part 22.

In order to ensure that the oscillation movement of animation part 22 suffers the least possible perturbations, the unit formed by lever 46 and animation part 22 may be balanced, wherein its center of gravity may be located substantially on the pivot axis of animation part 22.

Additional or alternative ways of ensuring the connection of animation part 22 with animation train 38 may be realized by other means than those represented and described. It may thus be possible to realize an animation part whose arm 22*d* may be considerably shortened and may bear a pin. Lever 46 may be replaced by a fine spring, fixed on the pin of lever 22*d*. The other end of the spring may be equipped with a protuberance in which a jewel similar to jewel 46*b* may be press-fitted. It may thereby be possible to have a more flexible elastic element.

Additionally or alternatively, animation part 22 could equally have a form other than that of a pendulum, with its verge and its bob, without departing from the scope of the invention. For example, animation part 22 could have the form of a boat, with an oscillating movement simulating the movement of waves, or of any other object performing a slow pendulum movement.

It is also contemplated that the components ensuring the drive of the animation part may be integrated directly onto the plate of the base caliber.

Figure 6:
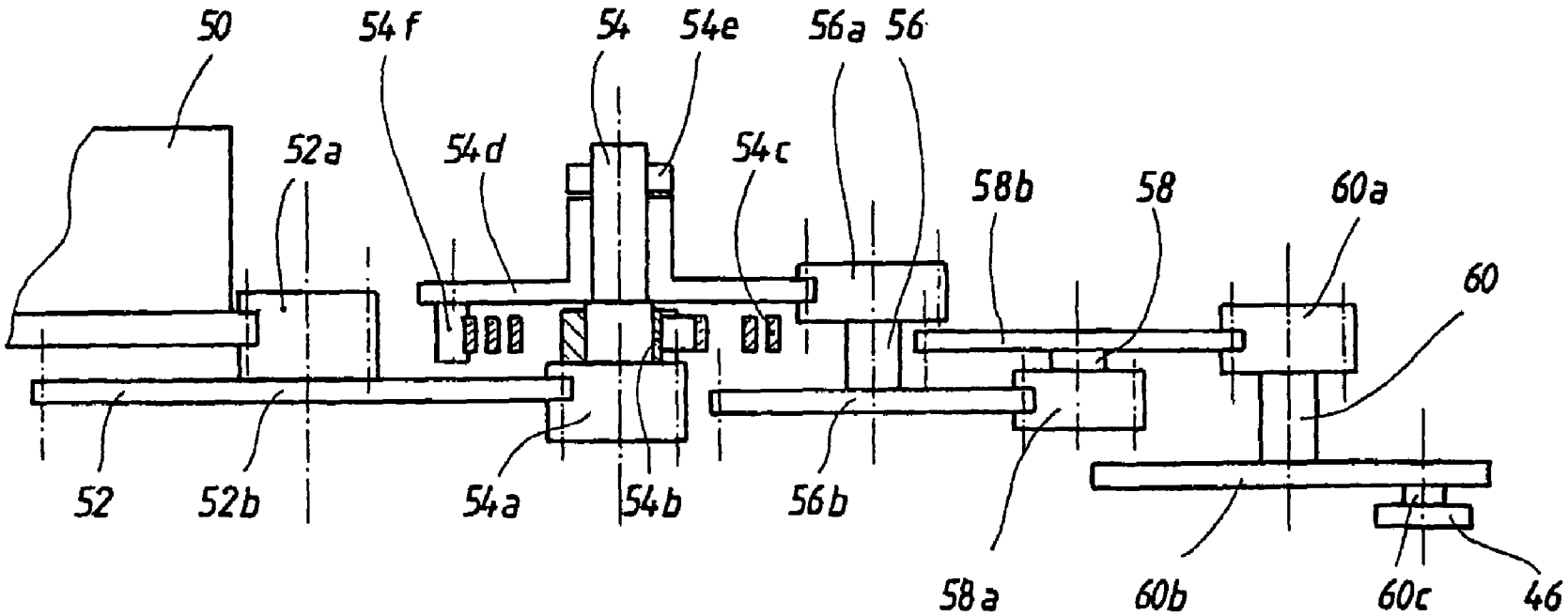
- FIG. 6 is a sectional view of a watch movement according to a second exemplary embodiment of the invention.

The exemplary embodiment shown in FIG. 6 may allow the smoothness of the movement of the automaton to be further improved. In FIG. 6, only the mobiles have been represented. The mobiles may pivot within the frame of the movement, generally between a bridge and the plate. In this exemplary embodiment, the driving element, which supplies the power to the work train, may be formed by a barrel spring, housed in a barrel 50, constituting the first mobile of the work train, the latter driving an escapement and a hairspring, which together may form a pulsed movement element. The animation train may include five mobiles 52, 54, 56, 58 and 60.

Mobile 52 may include a pinion 52*a*, in mesh with the toothing of barrel 50, and a wheel 52*b*, which drives mobile 54 via a pinion 54*a*. The latter may be attached to a collet 54*b*, fixed by press-fitting and bearing a balance spring 54*c*. A wheel 54*d* may be mounted relatively loosely on pinion 54*a*, held axially in place by a ring 54*e* press-fitted on the shaft of pinion 54*a*. Wheel 54*d* may be equipped with a stud 54*f* fixed to the end of balance spring 54*c*. Balance spring 54*c* may be fixed on collet 54*b* and on stud 54*f* in traditional manner, for example by gluing or welding. Pinion 54*a* and wheel 54*d* may thereby rotate as one, but may be elastically connected one to the other, dampening the jerks due to the jerky movements of the balance wheel. It is may also be possible to arrange balance spring 54*c* and its fixing means, i.e. collet 54*b* and stud 54*f*, in a single piece, press-fitted on pinion 54*a* and on a stud contained on wheel 54*d*.

Wheel 54*d* may mesh with mobile 56 and, more particularly, with pinion 56*a*, whereas wheel 56*b* may drive mobile 58 via pinion 58*a*. Wheel 58*b* may mesh with pinion 60*a* of mobile 60. The latter may include a board 60*b* bearing a rod 60*c*, similar to rod 44*e*, and on which lever 46 may pivot.

Board 60*b* may be dimensioned such that it may form a sufficient mass of inertia to enable balance spring 54*c* to remain slightly wound, such that the pendulum may continue moving between two alternations of the balance wheel. The dimensioning of the balance spring and of the mass of inertia may be delicate since the power may be tapped from a rapid mobile of the gear work train.

Additionally or alternatively, the tapping may be effected from the center wheel or from the third wheel. Nevertheless, by tapping the power at the level of the barrel, the number of mobiles contained between the element animated by a pulsed movement, i.e. the escapement, and the element simulating a sinusoidal movement, i.e. the pendulum, is such that their elasticity may be sufficient to make the impetuses of the balance wheel invisible. Therefore, it may not be essential to add a supplementary elastic element, even if the animation part oscillates at a relatively high frequency, such as, for example, 2 Hz.

Figure 7:
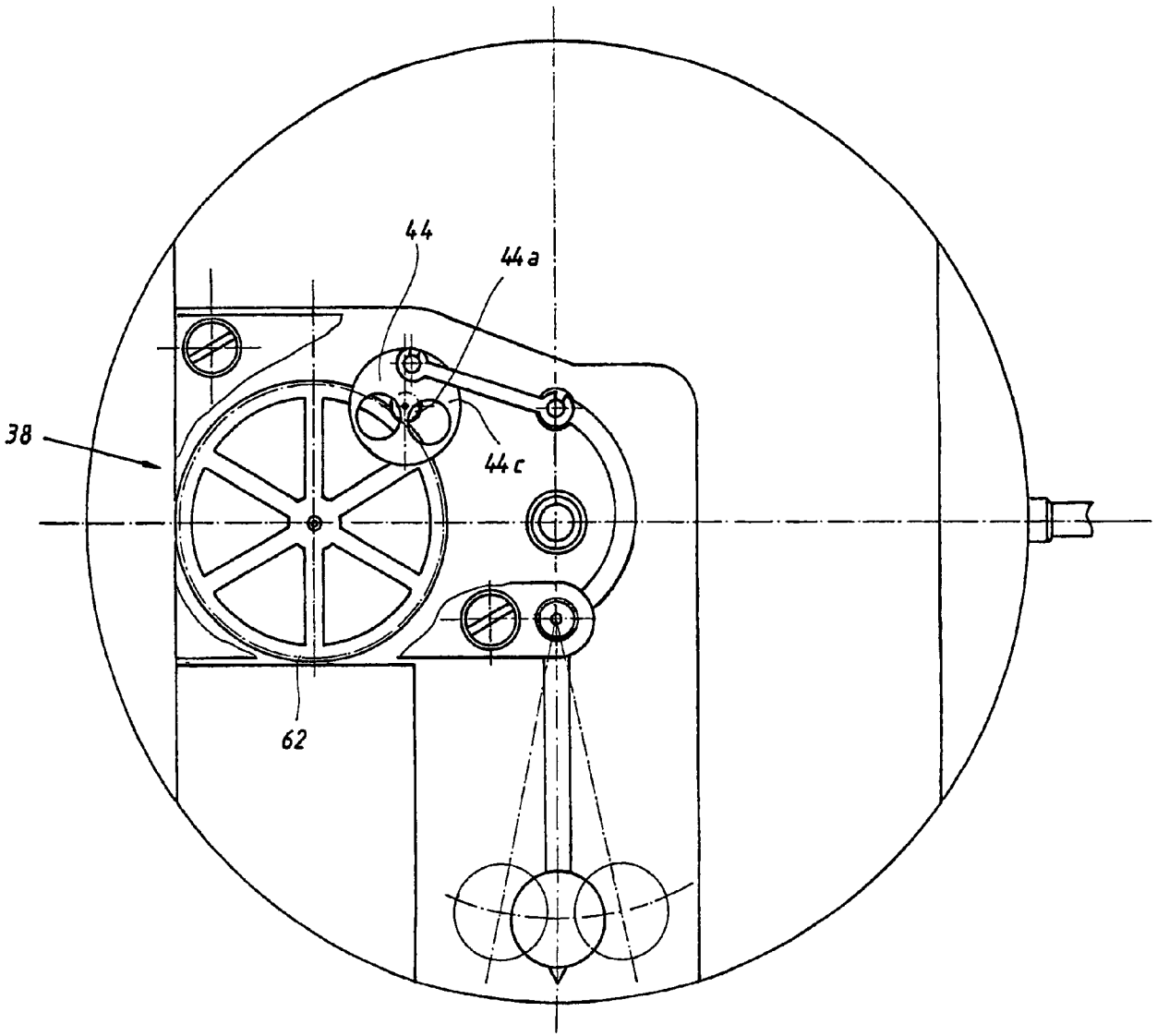
- FIG. 7 represents a third exemplary embodiment of the invention.

FIG. 7 shows another exemplary embodiment of the invention, in which the animation train 38 may be confined to a wheel 62 disposed on the shaft of the seconds wheel of the work train and the last mobile 44, whose pinion 44*a* may mesh with wheel 62. As explained above, board 44*c* may drive animation part 22.

The gearing ratio between wheel 62 and pinion 44*a* may be 1/12, such that the period of the animation part may be 5 seconds. In this case, the pulsed movement of the work train may be heavily reduced, on the one hand due to the high moment of inertia of wheel 62, and on the other hand due to the very small displacement of the animation part with each alternation of the balance wheel.

In order to prevent the gear shakes of the animation train from generating random movements of the animation part, it may be possible to equip the latter with a brake working upon the end of a pivot of its shaft.

In the examples described above, the control element for the animation part may be of the crank type. The same effect could be obtained by means of a cam and a lever resting against the cam.

Thus, by virtue of the particular characteristics exhibited by the movement according to the exemplary embodiments of the invention, it may be possible to realize a watch equipped with a slow animation that may bring a touch of serenity and calm, contrasting with the normal conditions of everyday life, and thus offering a little bit of calm to the wearer, even when he reads the time. Moreover, the presence of a wheel train may allow the pivot point of the animation part to be placed almost anywhere, and especially in the immediate vicinity of the center of the movement, which may provide the watch with an original aesthetic appearance.

The invention claimed is:

1. A mechanical-type watch movement, comprising a frame supporting:

a work train comprising a plurality of mobiles periodically driven in rotation by a driving element, a mobile animated by a pulsed movement, and having a kinematic connection with the work train, an animation part configured to be visible and arranged to be animated by a periodic movement, a control element for the animation part, and an animation train in mesh with a mobile of the work train, the animation train driving the control element, wherein the control element and the animation part are arranged so that the periodic movement is of a sinusoidal oscillating type, and wherein an elastic element interposed between the mobile of the work train and the animation part, the elastic element being configured to smooth out the movement of the animation part.

2. The movement of claim 1, wherein the mobile of the work train is a seconds mobile, and the animation train is arranged to accelerate the rotation speed of the seconds mobile toward a last mobile of the animation train cooperating with the animation part.

3. The movement of claim 2, wherein the animation part oscillates at a frequency ranging between 0.2 and 2 Hz.

4. The movement of claim 1, further comprising a lever having first and second ends, and a last mobile of the animation trains comprising a board, wherein the animation part and the board are equipped with eccentrically disposed connecting members connected to one of the ends of the lever.

5. The movement of claim 4, wherein the lever has, over at least a part of its length, an elastically deformable structure, configured to form the elastic element.

6. The movement of claim 1, wherein the elastic element elastically connects two coaxially disposed mobiles of the animation train.

7. The movement of claim 6, wherein the elastic element forms, with the animation part and the mobiles of a train interposed between that which cooperates with the animation part and that which is connected to the elastic element, an oscillating system, having a period ranging between that of the mobiles of the work train and that of the periodic movement of the part.

8. The movement of claim 1, wherein the animation part is mounted pivotably on the frame by a pivot axis and has a center of gravity located substantially on the pivot axis.

9. The movement of claim 1, wherein the frame comprises:

a first plate and a first bridge, between which the mobiles of the work train pivot, and a second plate on which the mobiles of the animation train and the animation part pivot, the second plate, the animation train and the animation part forming an independent module configured to be fixed by the second plate onto the first plate.

* * * * *